US006149391A

United States Patent [19]

Pohl et al.

[11] Patent Number: 6,149,391

[45] Date of Patent: Nov. 21, 2000

[54] HYDRAULIC DISPLACEMENT MACHINE

[75] Inventors: Andreas Pohl, Gross-Umstadt; Horst Rosenfeldt, Gross-Zimmern; Eckhardt Wendt, Leverkusen; Klaus Buesing, Odenthal, all of Germany

[73] Assignees: Carl Schenk AG, Darmstadt; Bayer AG, Leverkusen, both of Germany

[21] Appl. No.: 09/189,695

[22] Filed: Nov. 10, 1998

[30] Foreign Application Priority Data

Nov. 10, 1997 [DE] Germany ..... 197 49 060

[51] Int. Cl.[7] ..... F04F 11/00; F01D 1/00

[52] U.S. Cl. ..... 417/48; 188/268; 415/92

[58] Field of Search ..... 417/48, 50; 188/267.1, 188/268; 267/140.5; 415/92

[56] References Cited

U.S. PATENT DOCUMENTS

| | | | |
|---|---|---|---|
| 2,651,258 | 9/1953 | Pierce | 417/48 |
| 4,302,156 | 11/1981 | LaFlame | 416/169 A |
| 5,189,604 | 2/1993 | Iorio et al. | 415/90 |
| 5,816,372 | 10/1998 | Carlson et al. | 188/267.2 |
| 5,875,740 | 3/1999 | Ban et al. | 122/26 |
| 5,971,687 | 10/1999 | Ito et al. | 411/238 |
| 5,988,336 | 11/1999 | Wendt et al. | 492/21.5 |

FOREIGN PATENT DOCUMENTS

| | | | |
|---|---|---|---|
| 4003298 | 8/1991 | Germany . | |
| 5010350A | 1/1993 | Japan | F16D 31/06 |

OTHER PUBLICATIONS

Fluid Mechanics—Soviet Research, vol. 8, No. 4, Jul.–Aug., 1979, "Applications of the Electrorheological Effect in Engineering Practice", by R. G. Gorodkin et al., pp. 48 to 61.

*Primary Examiner*—Teresa Walberg
*Assistant Examiner*—Thor Campbell
*Attorney, Agent, or Firm*—W. F. Fasse; F. W. Fasse

[57] ABSTRACT

A hydraulic displacement machine that can operate as a pump or a motor in connection with an electrorheologic or magnetorheologic fluid includes a housing, a rotary piston arranged to rotate within a chamber in the housing, at least one displacement vane provided on the rotary piston, a plurality of field generating elements such as capacitor plate segments and/or coil arrangements that are each individually electrically energizable and that are arranged on the two sidewalls of the housing chamber distributed around the circumferential direction, and an actuator connected to each field generating element so as to move the elements of each pair selectively closer together and farther apart from each other. By applying an appropriate electric or magnetic field to the electrorheologic or magnetorheologic fluid between the field generating elements, the fluid is locally solidified in the "flow mode" to form a stationary seal plug within each fluid chamber between respective consecutive vanes. By moving the field generating elements of each pair closer together, the seal blockage is further solidified so as to additionally achieve a "squeeze mode" effect in the fluid.

21 Claims, 1 Drawing Sheet

HYDRAULIC DISPLACEMENT MACHINE

PRIORITY CLAIM

This application is based on and claims the priority under 35 U.S.C. §119 of German Patent Application 197 49 060.3, filed on Nov. 10, 1997, the entire disclosure of which is incorporated herein by reference.

FIELD OF THE INVENTION

The invention relates to a hydraulic displacement machine for use with an electrorheological or magnetorheological hydraulic fluid. The displacement machine includes at least one displacement vane provided on a rotary piston arranged in a chamber of the machine, as well as electrical or magnetic devices arranged in the chamber for generating electric or magnetic fields for controlling the rheologic properties of the hydraulic fluid in the chamber.

BACKGROUND INFORMATION

Electrorheologic fluids and magnetorheologic fluids are fluids having rheologic properties that can be influenced and controlled by the controlled application of an electric or magnetic field to the fluid. For example, the flow viscosity of the fluid can be varied in a continuous stepless manner from a relatively low viscosity whereby the fluid easily flows when no electrical or magnetic field is applied, to a relatively high viscosity in which the fluid is substantially solid and not flowable when a sufficient electric or magnetic field is applied. Typically, electrorheologic fluids and magnetorheologic fluids are suspensions, and particularly colloidal suspensions of solid particles in a carrier liquid, e.g. an insulating oil, whereby the solid particles are polarizable by means of the applied electric or magnetic field.

Through the use of such electrorheologic or magnetorheologic fluids, also called electroviscous or magnetoviscous fluids, it has become possible to construct various types of actuators without mechanical moving parts, or at least with a significantly reduced number of mechanical moving parts. Moreover, these fluids having a controllable viscosity are also used in applications as diverse as hydraulic valves, hydraulic piston-cylinder devices, vibrators, viscous couplings, shock absorbers, motor bearings, and the like (see the general survey article by R. G. Gorodkin et al., entitled "Applications of the Electrorheological Effect in Engineering Practice", FLUID MECHANICS-Soviet Research, Vol. 8, No. 4, July-August 1979, pgs. 48 to 61).

Electrorheologic fluid actuators typically use an energy conversion device including an arrangement of electrodes for applying a controlled electric field to the electrorheologic fluid that is located between the electrodes. An electric control voltage is then applied to the electrodes. The interaction between the electrode arrangement and the electrorheologic fluid can generally be divided into three categories depending on the type of fluid deformation, respectively corresponding to three basic modes. In the "shear mode", the electrodes are slidingly displaced relative to each other in parallel planes such that the fluid is subjected to shear between the electrodes. In the "flow mode", the electrodes are rigidly and stationarily arranged while the fluid flows between the electrodes. In the "squeeze mode", the electrodes are moved relative to each other so as to change the spacing distance therebetween, thus applying a "squeeze" to the fluid between the electrodes. These different modes may also arise in combination.

A particular example of a mechanical device using an electroviscous fluid is disclosed in German Patent Laying-Open Document 4,003,298 (Andreas Pohl). This publication describes a fluid pump or fluid motor operating according to the displacement principle. The known hydraulic displacement machine includes a vane connected to a rotor that is arranged to rotate in a chamber of a housing. Capacitor plate segments are arranged on the side walls of the chamber, and are connected to electric conductors so that they can be individually electrically energized. The chamber is filled with an electroviscous fluid.

When an electric voltage is applied to the capacitor plate segments in the known hydraulic machine, the electroviscous fluid in the chamber between the capacitor plate segments becomes relatively rigidified to form a blockage. As a result, a suction chamber of the pump is formed between the vane and the blockage on one side, and a pressure chamber of the pump is formed between the vane and the blockage on the other side. As the pump vane rotates in the chamber, fluid is thus sucked into the suction chamber from a suction port and displaced out of the pressure chamber to a pressure port of the pump. In order to maintain the pumping and sucking effect, the electric energization of the condenser plate segments is appropriately controlled to sequentially energize and then de-energize the capacitor plate segments corresponding to the rotation motion of the pump vane on the rotor.

While the hydraulic pump or motor disclosed in German Patent Laying-Open Document 4,003,298 has been shown to be effective for achieving its intended purposes, it has been found that improvements in the output pressure, throughflow volume, efficiency and effective power can be achieved.

SUMMARY OF THE INVENTION

In view of the above it is an object of the invention to provide a hydraulic displacement machine of the above discussed general type that is improved so as to achieve higher pressures, greater throughflow volumes, a greater efficiency, and a higher power density, relative to prior art displacement machines having the same structural dimensions.

The above objects have been achieved in a hydraulic displacement machine according to the invention, comprising a housing, a rotor rotatably supported within the housing, whereby the rotor includes a rotary piston rotatably arranged within a chamber of the housing and at least one displacement vane provided on the rotary piston and at least one pair of electrically energizable field generating elements comprising capacitor plate segments and/or electric coil arrangements distributed around the circumferential direction on opposite side walls of the housing chamber, whereby the field generator elements of a respective pair are movable relatively toward and away from each other so that the spacing distance therebetween is variable. The machine further preferably includes an actuator connected to at least one pair of the field generator elements and adapted to move the field generator elements selectively toward and away from each other.

The hydraulic displacement machine is particularly adapted to operate with an electrorheologic or magnetorheologic fluid filled into and passing through the housing chamber. The machine includes the capacitor plate segments when it is to be used in connection with an electrorheologic fluid, and includes the coil arrangements when it is to be used in connection with a magnetorheologic fluid. As a further alternative, the displacement machine can include both the capacitor plate segments and the coil arrangements when it is to be used in connection with a fluid having both electrorheologic and magnetorheologic properties, for example a mixture of an electrorheologic fluid and a magnetorheologic fluid. Furthermore, the hydraulic displacement machine according to the invention can be particularly embodied and operated as a hydraulic pump or as a hydraulic motor.

According to the invention, the displacement machine operates using the following effects. First, the invention provides an effect in the above mentioned "flow mode". In this context, the field generating elements, e.g. the capacitor plate segments and/or the coil arrangements, are energized in such a manner that the electrorheologic or magnetorheologic fluid in the area between the field generating elements becomes more viscous and ultimately solidified or rigidified, so as to form a blockage. This blockage prevents the fluid from flowing or being displaced by the displacement vane past the blockage. The rigidification of the fluid involves the solid particles suspended in the fluid becoming oriented into chains due to the effect of the applied electric or magnetic field. The rigidified areas behave as elastic solid bodies.

The invention provides a second effect in the above mentioned "squeeze mode". The pressure of the fluid in the pressure medium chamber can be increased by moving the field generating elements of a respective pair toward each other. Thereby, the volume of the pressure medium chamber is reduced, and the electrorheologic or magnetorheologic fluid is additionally caused to behave according to the "squeeze mode". In this mode, due to the displacement of the capacitor plate segments toward each other, opposed electrostatic counter forces act on and between the solid particles that have been oriented into chain configurations in the fluid. This effect causes a further stiffening or rigidification of the fluid. As a result, it is possible to achieve a pumping pressure that is ten times higher using the solidified electrorheologic fluid acting as a blockage or plug in the combined "flow mode" and "squeeze mode", as compared to the pressure that can be achieved in the flow mode alone, before the solidified blockage or plug will be displaced out of its position due to the high pressure.

According to a particular embodiment of the invention, the rotary piston is equipped with six displacement vanes, whereby six pressure medium chambers are formed between the displacement vanes within the circular or annular housing chamber. Each pressure medium chamber is connected to a suction line and a pressure line through corresponding channels. A respective pair of opposed field generating elements allocated to each respective pressure medium chamber is arranged on the opposite side walls of the housing. With this arrangement, first, each pair of field generating elements can be individually and differently electrically energized and motion-actuated, and secondly, the individual suction and pressure lines of the pressure medium chambers can be connected in series or in parallel.

By selecting the desired arrangement, different throughflow volumes and different output pressures can be achieved, depending on the operating mode and the degree and sequence of energization of the field generating elements, and depending on the connection, i.e. in series or in parallel, of the pressure medium lines. More specifically, a maximum throughflow at low pressure can be achieved by using a parallel connection, or a minimum throughflow at a high pressure can be achieved using a series connection. By properly switching on and switching off the field generating elements, the fluid throughflow can be controlled to achieve an impulse throughflow regulation.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
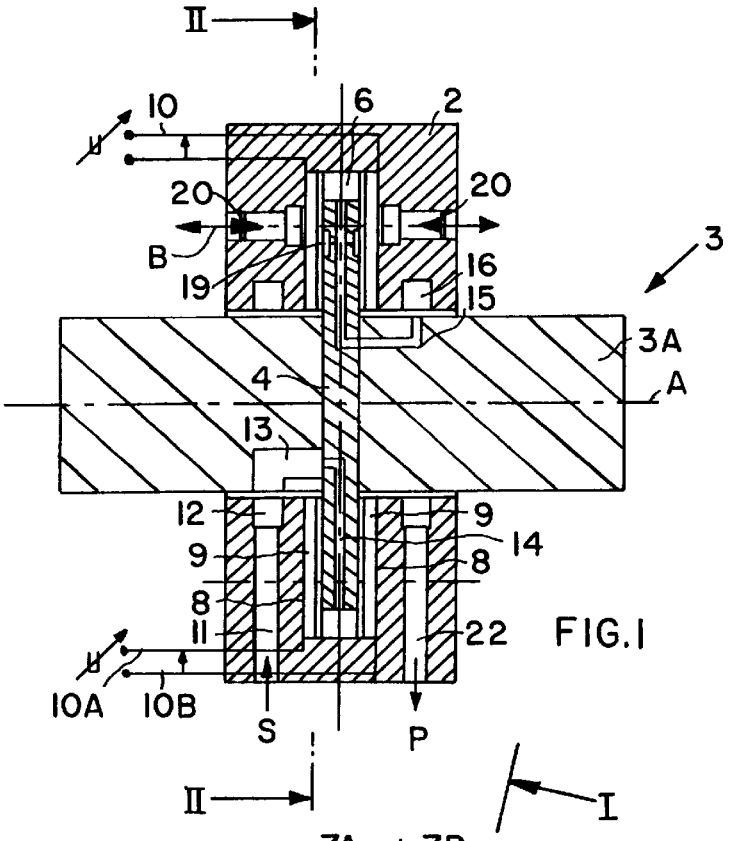
FIG. 1 is a sectional view of a hydraulic displacement machine according to the invention, embodied as a rotary vane pump, seen on a section plane along the line I—I in FIG. 2.

The hydraulic displacement machine 1 shown in FIG. 1 is especially embodied as a rotary vane pump 1, but it should be understood that the displacement machine can generally also be operated or embodied as a hydraulic motor. The rotary vane pump 1 includes a generally cylindrical housing 2, with a rotor 3 arranged so as to be rotatable about the rotation axis A in the housing 2. The rotor 3 includes a rotor shaft 3A and a substantially disk-shaped rotary piston 4 connected to the rotor shaft 3A. The outer circumferential perimeter of the rotary piston 4 is configured with radial protrusions forming displacement vanes 5 distributed uniformly about the circumference of the rotary piston 4. An electric motor or the like, which is not shown, is coupled to the rotor shaft 3A so as to rotate the rotor shaft 3A and the rotary piston 4 in the rotation direction R, whereby the rotary piston 4 rotates within an annular chamber 6 enclosed in the cylindrical housing 2.

Figure 2:
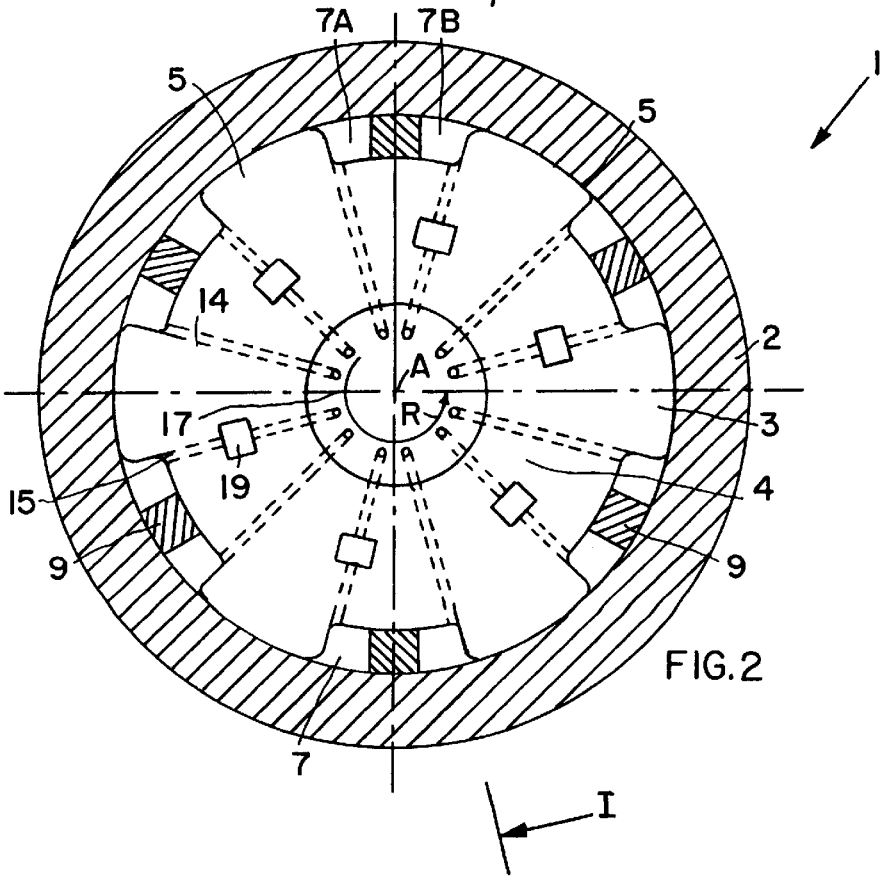
FIG. 2 is a sectional view of the rotary vane pump of FIG. 1 seen on a radial section plane along the line II—II in FIG. 1.

As especially shown in FIG. 2, the present example of the displacement machine 1 includes six displacement vanes 5, whereby six pressure medium spaces or chambers 7 are formed in the annular chamber 6 between the cylindrical housing 2 and the rotary piston 4. Namely, the displacement vanes 5 divide the annular chamber 6 into six pressure medium chambers 7 respectively between adjacent displacement vanes 5.

The annular chamber 6 is bounded by opposite facing side walls 8 of the housing 2. A respective set of six substantially stripe-shaped radially extending capacitor plate segments 9 is arranged on each of the two side walls 8, with the respective segments 9 regularly spaced from each other in the circumferential direction and positioned so that respective pairs of capacitor plate segments 9 are aligned and facing opposite each other on the two opposite side walls 8. The capacitor plate segments 9 are respectively electrically insulated from the housing 2 and from each other in any known manner, and are individually connected to respective electrical conductors 10A and 10B, which in turn are connected to an electric control arrangement. The electric control arrangement is not shown, but may comprise any known control circuitry suitable for individually applying a controlled voltage to the respective pairs of capacitor plate segments 9 through the respective pairs of electrical conductors 10A and 10B. This arrangement is merely schematically shown in FIG. 1 for simplicity.

The capacitor plate segments 9 are arranged to be movable relative to the side walls 8 of the housing 2, namely such that the capacitor plate segments 9 of each respective pair can be selectively moved toward or away from each other. In this manner, the volume of the respective pressure medium chambers 7 can be reduced to apply a "squeeze" to the fluid therein. Preferably, both capacitor plate segments 9 of each pair are movable, but it is also possible to arrange only one of the capacitor plate segments of each pair to be movable relative to the other.

Actuators 20, which are merely schematically illustrated, are arranged in the housing 2 and respectively connected to the capacitor plate segments 9 for driving the above described motion of the capacitor plate segments 9. This motion is preferably a vibratory motion, and is schematically illustrated by the arrows B. The actuators 20 may comprise any known configuration or arrangement of electromechanical, piezoelectric, magnetic, hydraulic, or magnetostrictive actuators, and are preferably vibratory actuators. The control circuitry or further arrangements necessary for energizing and controlling the actuators are not shown in the drawings for simplicity, but can involve any known actuating and energizing circuitry.

A suction line 11 providing a fluid suction S leads from a fluid supply reservoir (not shown) through the housing 2 to an annular groove 12 surrounding the rotor 3. In turn, a supply channel 13 formed in the rotor 3 leads from the annular groove 12 to a respective mouth or suction channel 14 on the back side or suction side of each displacement vane 5. A respective pressure channel 15 leads from the front side or pressure side of each displacement vane 5, as seen in the rotation direction R, through the rotor 3 to an outlet annular groove 16, from which a fluid outlet or pressure line 22 leads out through the housing 2 providing a fluid pressure P to be connected to the device that uses the pressurized fluid. In the example embodiments shown in FIGS. 1 and 2, the pressure medium lines are connected in series, whereby a maximum pressure and a low throughflow volume are achieved. Throughout this specification, the terms "line", "channel" and the like are used to designate any structural member forming a passage through which a fluid may flow.

An electrorheologic fluid is provided in the pressure medium chambers 7 and flows through the pump. When the control arrangement applies an appropriate electric voltage via the electrical conductors 10A and 10B to a respective pair of opposite capacitor plate segments 9, the electrorheologic fluid located between these opposite capacitor plate segments 9 solidifies or rigidifies to form a substantially solid blockage or plug which forms a seal in this respective circumferential region within the pressure medium chamber 7. As a result, this plug of solidified fluid located between two successive displacement vanes 5 divides the respective pressure medium chamber 7 between the two successive vanes 5 into two working chambers 7A and 7B that are sealed from each other by the plug of solidified fluid.

When the rotor 3 is driven to rotate the rotary piston 4 and the displacement vanes 5 in the direction R as shown by the arrow 17, the two working chambers 7A and 7B respectively have a variable volume. Namely, the working chamber 7A that becomes larger forms a suction chamber, while the chamber 7B that becomes smaller forms a pressure chamber, because the solidified plug remains stationary with the capacitor plate segments 9 in the housing 2, as the rotary vanes 5 rotate relative to the solidified plug. As a result, the rear sides or suction sides of the moving vanes 5 suck fluid out of the suction line 11 through the suction channels 14 into the suction chambers 7A, while the forward or pressure sides of the moving vanes 5 pressurize the fluid present in the pressure chambers 7B and then displace the pressurized fluid through the pressure channels 15, via the outlet annular groove 16 to the fluid output or pressure line 22 and ultimately to the device that is using the pressurized fluid.

Simultaneously with the above described electrical energizing of the capacitor plate segments 9, the actuators 20 are imposing a vibrating movement on the capacitor plate segments 9 selectively toward and away from each other, whereby the electrorheologic fluid is additionally caused to behave in the squeeze mode. As described above, when the solidified electrorheologic fluid forming the plug is additionally placed into the squeeze mode, it is solidified even further so that it forms a stronger, more solid and more pressure-resistance seal between the respective suction chamber 7A and pressure chamber 7B. Depending on the output pressure that is required, respective pairs of the capacitor plate segments 9 may be energized or de-energized as needed, and the squeeze mode can be activated by means of the actuators 20 to the extent required.

As the rotary piston 4 rotates, the respective pairs of capacitor plate segments 9 must be energized and de-energized in sequence to match the rotation of the rotary piston 4. Namely, once a respective displacement vane 5 rotates to a position immediately adjacent or rotationally before a respective pair of capacitor plate segments 9, this pair of capacitor plate segments 9 is deenergized so that the solidified fluid plug is electrorheologically liquified, to allow the displacement vane 5 to pass by without resistance. Once the respective vane 5 has rotated past the position of the respective pair of capacitor plate segments 9, this pair is again energized to re-establish a solidified seal plug.

Hydrostatic bearings 19 are preferably provided on the outer disk surfaces 18 of the rotary piston 4 facing the side walls 8 of the annular chamber 6. Each hydrostatic bearing 19 respectively includes a bearing pocket formed in the respective disk surface 18, that is connected through a hydraulic throttle or constriction valve to a respective one of the pressure channels 15. In this manner, pressurized fluid is constantly provided to the bearing pocket of each hydrostatic bearing 19, which achieves an effective hydraulic centering of the rotary piston 4 and its vanes 5 between the two side walls 8 of the annular chamber 6.

Instead of the use of an electrorheologic fluid as described above, the inventive machine can also operate with a magnetorheologic fluid or a mixture of both types of fluids. In such a case, electrically energizable coil arrangements would be provided instead of some or all of the capacitor plate segments 9. The coil arrangements would generate a magnetic field in any known manner, so as to influence the rheology of the magnetorheologic fluid.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A hydraulic displacement machine comprising:

a housing including two sidewalls bounding a housing chamber therebetween;

a rotor rotatably supported in said housing, comprising a rotary piston and at least one fluid displacement vane provided on said rotary piston, wherein said rotary piston is rotatably arranged in said housing chamber; and at least one pair of field generating elements selected from capacitor plates and electrical coils arranged respectively opposite each other on said two sidewalls, wherein at least one of said field generating elements of said pair is a movable field generating element arranged to be movable relatively toward and away from the other of said field generating elements of said pair;

wherein said machine is adapted for use in connection with at least one of an electrorheolocic fluid and a magnetorheoloqic fluid in said housing chamber.

2. The hydraulic displacement machine according to claim 1, further comprising an actuator connected to said movable field generating element and adapted to move said movable field generating element toward and away from said other field generating element.

3. The hydraulic displacement machine according to claim 2, wherein said other field generating element is also arranged to be moveable, and further comprising a second actuator connected to said other field generating element and adapted to move said other field generating element toward and away from said movable field generating element.

4. The hydraulic displacement machine according to claim 2, comprising a plurality of said pairs of field generating elements arranged distributed around a circumferential direction on said two sidewalls.

5. The hydraulic displacement machine according to claim 4, further comprising a plurality of pairs of electrical conductors respectively connected to said pairs of field generating elements separately from other ones of said pairs of field generating elements.

6. The hydraulic displacement machine according to claim 5, further comprising a controlled voltage source connected to said electrical conductors and adapted to apply a controlled voltage independently and selectively to said pairs of field generating elements via said pairs of electrical conductors.

7. The hydraulic displacement machine according to claim 2, wherein said actuator is a vibrational actuator adapted to cause a vibrational motion of said movable field generating element.

8. The hydraulic displacement machine according to claim 2, wherein said actuator comprises a piezoelectric actuator.

9. The hydraulic displacement machine according to claim 2, wherein said actuator comprises a magnetostrictive actuator.

10. The hydraulic displacement machine according to claim 2, wherein said actuator is selected from electromechanical, magnetic, and hydraulic actuators.

11. The hydraulic displacement machine according to claim 2, wherein said actuator is set into one of said sidewalls under said movable field generating element.

12. The hydraulic displacement machine according to claim 2, wherein said field generating elements comprise said capacitor plates, and said machine is adapted for use in connection with said electrorheologic fluid in said housing chamber.

13. The hydraulic displacement machine according to claim 12, further in combination with said fluid in said housing chamber, wherein said fluid is adapted to become solidified and form a seal barrier in said housing chamber between said two sidewalls, said rotary piston and an annular wall of said housing when said pair of field generating elements and said actuator are respectively energized, and wherein said seal barrier divides said housing chamber into a pressure chamber and a suction chamber on opposite sides of said seal barrier.

14. The hydraulic displacement machine according to claim 2, wherein said field generating elements comprise said electrical coils, and said machine is adapted for use in connection with said magnetorheologic fluid in said housing chamber.

15. The hydraulic displacement machine according to claim 14, further in combination with said fluid in said housing chamber, wherein said fluid is adapted to become solidified and form a seal barrier in said housing chamber between said two sidewalls, said rotary piston and an annular wall of said housing when said pair of field generating elements and said actuator are respectively energized, and wherein said seal barrier divides said housing chamber into a pressure chamber and a suction chamber on opposite sides of said seal barrier.

16. The hydraulic displacement machine according to claim 2, comprising a plurality of said pairs of said field generating elements, wherein at least one said pair comprises said capacitor plates and at least one said pair comprises said electrical coils, and wherein said at least one of an electrorheolocic fluid and a magnetorheologic fluid comprises a fluid having both electrorheologic and magnetorheologic properties.

17. The hydraulic displacement machine according to claim 16, further in combination with said fluid in said housing chamber, wherein said fluid is adapted to become solidified and form a seal barrier in said housing chamber between said two sidewalls, said rotary piston and an annular wall of said housing when said pairs of field generating elements and said actuator are respectively energized, and wherein said seal barrier divides said housing chamber into a pressure chamber and a suction chamber on opposite sides of said seal barrier.

18. The hydraulic displacement machine according to claim 2, wherein said field generating elements are respectively configured as radially extending elongated stripes on said sidewalls.

19. The hydraulic displacement machine according to claim 1, further comprising a suction line and a pressure line respectively leading out of said housing, wherein said rotor comprises a total of exactly six of said fluid displacement vanes provided on said rotary piston, wherein a total of six pressure medium chambers are formed in said housing chamber respectively between and bounded by respectively adjacent ones of said six vanes, and each of said pressure medium chambers is respectively in fluid communication with said pressure line and with said suction line.

20. The hydraulic displacement machine according to claim 19, wherein six suction channels and six pressure channels extend radially outwardly through said rotor, such that a respective one of said pressure channels and a respective one of said suction channels open in fluid communication into each respective one of said pressure medium chambers, and wherein all of said pressure channels communicate with said pressure line and all of said suction channels communicate with said suction line.

21. The hydraulic displacement machine according to claim 20, wherein said rotary piston has two side faces respectively facing said two sidewalls, and further comprising six hydraulic bearing pressure pockets respectively opening on each said side face and respectively communicating with each said pressure channel.

* * * * *